US006332543B1

(12) United States Patent
Niehues et al.

(10) Patent No.: US 6,332,543 B1
(45) Date of Patent: Dec. 25, 2001

(54) APPARATUS FOR CONVERTING A CONTINUOUSLY SUPPLIED MATERIAL FLOW INTO A SINGLE LAYER

(75) Inventors: Heiko Niehues; Torsten Koch, both of Hamburg; Renke Schlarmann, Wentorf; Harry Drewes, Hamburg; Hans Dierken, Amelinghausen, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/503,320

(22) Filed: Feb. 14, 2000

(30) Foreign Application Priority Data

Feb. 13, 1999 (DE) ..... 199 06 125
Apr. 24, 1999 (DE) ..... 199 18 774

(51) Int. Cl.[7] ..... B07C 5/02; B65G 47/31

(52) U.S. Cl. ..... 209/539; 209/639; 209/642; 198/461.2; 198/638

(58) Field of Search ..... 209/539, 642, 209/576, 577, 587, 639; 198/461.1, 461.2, 461.3, 579, 638

(56) References Cited

U.S. PATENT DOCUMENTS 5,148,923 * 9/1992 Fraenkel et al. ..... 209/539
5,558,199 9/1996 Roether et al. ..... 198/461.2
5,669,511 * 9/1997 Satake et al. ..... 209/587 X

FOREIGN PATENT DOCUMENTS 56-98155 * 8/1981 (JP) ..... 198/461.3

* cited by examiner

*Primary Examiner*—Tuan N. Nguyen
(74) *Attorney, Agent, or Firm*—Venable; Robert Kinberg

(57) ABSTRACT

There is provided an apparatus which can simplify, expedite and enhance the segregation of undesirable particles from desirable particles in a multiple-layer flow wherein the desirable and undesirable particles are randomly intermixed with each other. This is accomplished by a stepwise reduction of the thickness of the flow to thus locate all or nearly all undesirable particles at or close to the exposed sides of the resulting relatively thin flow so that the undesirable particles can be readily detected and segregated from the thin flow. The stepwise reduction of thickness of the original flow is effected by a cascade of successive accelerating conveyors including a first conveyor which receives successive increments of the original flow from a vibratory trough, and a faster second conveyor which receives successive increments of the accelerated flow from the first conveyor and cooperates with an overhead conveyor to define a channel for advancement of the repeatedly accelerated original flow into the range of instrumentalities for detection and segregation of undesirable particles.

16 Claims, 2 Drawing Sheets

APPARATUS FOR CONVERTING A CONTINUOUSLY SUPPLIED MATERIAL FLOW INTO A SINGLE LAYER

CROSS-REFERENCE TO RELATED CASES

This application claims the priorities of commonly owned German patent applications Serial Nos. 199 06 125.4 (filed Feb. 13, 1999) and 199 18 774.6 (filed Apr. 24, 1999). The disclosures of the above-referenced German patent applications, as well as that of each US and foreign patent and patent application mentioned in the specification of the present application, is incorporated herein by reference.

BACKGROUND OF THE INVENTION

The present invention relates to improvements in apparatus for classifying the constituents of a stream or flow of randomly intermixed particles, and more particularly to improvements in apparatus of the type wherein the classifying or segregating stage is preceded by a reduction of the thickness or height of the stream or flow to thus facilitate access to those (undesirable) particles which are to be segregated from other particles. Still more particularly, the invention relates to improvements in that part or in those parts of the above outlined apparatus which serves or serve to convert a flow or stream of randomly intermixed (acceptable) first and (undesirable) second particles jointly forming two or more superimposed layers or strata into a second flow or stream wherein the number of layers is less than in the original stream.

It is well known and readily comprehensible that the removal of impurities and/or other particles from a thin layer, and especially from a single layer, of randomly intermixed useful and foreign particles is simplified and rendered more reliable if a moving flow or stream of intermixed useful and foreign particles is first converted into a single layer which is thereupon moved past suitable scanning or monitoring and ejecting or segregating (e.g., pneumatic ejecting) instrumentalities.

In the following passages of this specification, the term "first flow" will denote a flow or stream having a number of layers exceeding that number which is considered sufficently low to guarantee reliable detection and subsequent segregation of all undesirable particles (such as foreign particles and impurities). For example, a first flow of particles of comminuted tobacco leaves can contain highly satisfactory tobacco shreds constituting elongated comminuted tobacco leaf laminae as well as less desirable material including fragments of tobacco stem or tobacco ribs, so-called birds' eyes, pieces of rock and/or others. A "second flow" can contain the same constituents as the first flow except that it contains a single layer or a number of layers sufficiently low to permit reliable detection of foreign particles and impurities by optical, magnetic and/or other suitable means. The rod-like filler of a plain cigarette is considered to be of inferior quality if it contains a relatively high percentage of foreign particles and/or impurities. Moreover, relatively hard particles of tobacco stem, tobacco ribs, metallic fragments or the like are apt to puncture the tubular wrapper for the rod-like filler of a plain cigarette.

A particle flow of relatively low density is interpreted as constituting a flow of tobacco particles, as well as other commodities (such as for example foodstuffs), having a specific weight which is relatively low in comparison with the resistance it offers to the flow of air. Typical examples of such particles are tobacco leaf laminae and spinach; such particles and their fragments, as well as fragments of other sheet- or panel-shaped products encompassing, among others, fragments of salad as well as tobacco leaves—in contrast to stems or stem-shaped constituents of various vegetable products including tobacco stems, green beans as well as bundle- and bush-shaped gatherings of certain products including among others fresh thymian—can also be manipulated in the apparatus of the present invention.

All of the above-enumerated products, especially foodstuffs, exhibit the common characteristic that they must be cleaned, or inspected for the purpose of ascertaining the extent of their cleanness, with a very high degree of precision. Though not a foodstuff, tobacco can be said to belong to) the same category because it must be cleaned with a very high degree of precision and must be maintained in a state of absolute cleanness all the way to completion of its processing regardless of whether the final product is any one of various rod-shaped commodities including plain cigarettes, filter cigarettes, cigarillos, cigars or the like, or any other rod-shaped products. On the other hand, tobacco leaves often carry substantial quantities of impurities of a variety of sizes and shapes which strongly adhere to the constituents of rod-shaped smokers' products and/or are intimately admixed thereto. Moreover, it is advisable to segregate such foreign particles from useful constituents of tobacco leaves as expeditiously as possible because the foreign particles can interfere with predictable and/or optimal processing of tobacco. It has been found that tobacco leaf laminae (i.e., tobacco leaves devoid of rib and stem) are particularly likely to be processed with similar commodities of equal size and/or shape which are not desirable in smokers' products and, therefore, the laminae should be segregated from such undesirable foreign particles if the quality of tobacco products is to be kept at a desired level.

Commonly owned U.S. Pat. No. 5,558,199 granted Sep. 24, 1996 to Friedmann ROETHER et al. for "APPARATUS FOR FORMING A LAYER OF TOBACCO PARTICLES" discloses a highly satisfactory proposal to convert a continuously supplied multiple-layer first flow of particulate material containing randomly intermixed useful and foreign particles (such as fragments of desirable tobacco leaf laminae and fragments of randomly distributed impurities and/or fragments of tobacco ribs, stalks, eyes and the like) into a second flow containing only desirable particles. This is accomplished in that the number of layers in the first flow is reliably reduced to a number (e.g., one) which is sufficiently low to guarantee that the foreign particles can be readily detected and segregated from the useful particles. Moreover, detection and segregation of foreign particles can be carried out by employing a relatively simple but highly reliable apparatus.

OBJECTS OF THE INVENTION

An object of the invention is to provide an apparatus having an output exceeding that of the apparatus patented to ROETHER et al. without affecting the quality of the monitoring and segregating operations.

Another object of the invention is to provide an apparatus which can increase the rate of segregation of impurities in a simple but highly efficient manner.

A further object of the invention is to provide the improved apparatus with novel and improved means for converting the first flow into the second flow.

An additional object of the invention is to provide an apparatus which can be combined with or embodied in available machines for the making of rod-shaped products of the tobacco processing industry.

Still another object of the invention is to provide an apparatus which can relieve the mixture of acceptable or desirable particles and undesirable or foreign particles from undesirable or foreign particles in a single pass of the mixture through a series of successive stations including a layer-thinning station, a foreign particle detecting station, a station for segregation of detected foreign particles and a station for reception of acceptable particles at a suprisingly high speed.

An additional object of the invention is to provide a novel and improved method of reliably relieving a flow of comminuted tobacco leaves of impurities including undesirable fragments of tobacco leaves and/or various particles which adhered to the tobacco leaves prior to the comminutig (such as shredding) step.

SUMMARY OF THE INVENTION

The invention resides in the provision of an apparatus for converting a continuously supplied multiple-layer first flow of a particulate material containing randomly intermixed useful and foreign particles into a second flow which, during advancement of particulate material in a predetermined direction along a predetermined path, includes a number of layers less than the number of layers in the multiple-layer first flow. The improved apparatus comprises at least one transporting unit having means (such as at least one oscillatory trough) for advancing the first flow at a first speed along a first portion of the predetermined path, and a plurality of successive conveyors adjacent successive second portions of the predetermined path and arranged to repeatedly accelerate the first flow along the respective second portions of the predetermined path with attendant reduction of the number of layers in the flow on the conveyors. The conveyors include a first conveyor serving to receive particles of the first flow from the advancing means and a last conveyor, and the apparatus further comprises means for segregating foreign particles from useful particles not later than on or downstream of the last conveyor.

The conveyors preferably include endless flexible elements (e.g., in the form of belts or bands) which are trained over pulleys or analogous driving elements and have upper reaches serving to advance the layers of useful and foreign particles along the second portions of the predetermined path. The second portions of the predetermined path can, and preferably do, immediately follow each other.

The aforementioned oscillatory trough of the at least one transporting unit can be arranged to advance a first flow having a thickness (height) in the range of between 4 and 10 millimeters, particularly about 7 millimeters.

The endless flexible element of the first conveyor can be driven at a speed of between 2.5 and 3.5 meters per second so that the upper reach of such endless flexible element advances the first flow in a direction away from the at least one transporting unit. Such speed at least approximates the so-called floating speed of the particles in at least one of the flows, for example, in the first flow.

The apparatus preferably further comprises an additional conveyor which defines with the last conveyor a channel having a height diminishing in the predetermined direction and means for driving the additional conveyor in synchronism with the last conveyor.

The upper reach of the endless flexible element of the last conveyor bounds the channel from below, and the additional conveyor preferably comprises an endless flexible element having a lower reach bounding the channel from above and being driven by one or more pulleys which move the lower reach in the predetermined direction.

The apparatus further comprises means for respectively driving the endless flexible elements of the first and last conveyors (i.e., the respective pulleys) at a first speed and a second speed higher than the first speed. The ratio of the first and second speeds is or can be such that the thickness of the flow on the first conveyor is at least approximately twice the thickness of the flow on the last conveyor. The upper reach of the endless flexible element of at least one of the first and last conveyors can constitute an at least substantially horizontal flow-supporting reach.

The aforementioned channel between the last conveyor and the additional conveyor is preferably flanked by suitable sidewals, e.g., sidewalls made of or containing a metallic sheet material. Such sidewalls can include substantially horizontal upper portions which slidably engage and guide the adjacent portions of the lower reach of the additional conveyor. Furthermore, the lower portions of such sidewalls can be provided with flexible lips which preferably sealingly engage the adjacent marginal portions of the upper reach of the endless flexible element of the last conveyor.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
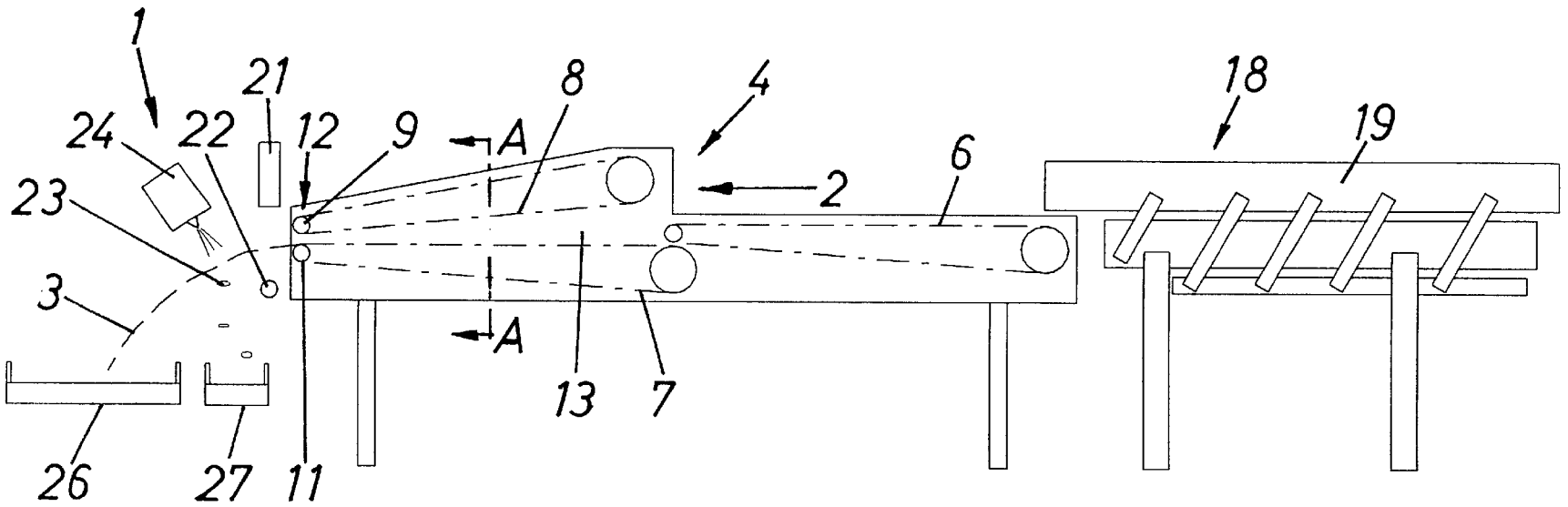
FIG. 1 is a schematic side elevational view of an apparatus which embodies one form of the present invention.

Referring first to FIG. 1, there is shown an apparatus which comprises a particle transporting unit 18 including an oscillatory trough 19 which showers successive increments of a continuous first flow or stream of intermixed satisfactory particles 3 and foreign particles 23 onto the upper reach of an endless flexible element (e.g., belt) of a first conveyor 6 of a cascade 4 of at least two successive conveyors. The cascade of the apparatus which is shown in FIG. 1 comprises the first conveyor 6 and a second or last conveyor 7. The endless flexible element (e.g., a belt best shown in FIG. 2) of the second or last conveyor 7 has an at least substantially horizontal upper reach which is parallel to and is located at a level below that of the upper reach of the endless belt of the first conveyor 6. The speed at which the belt of the first conveyor 6 is driven to advance the first flow in the direction indicated by an arrow 2 is less than the speed of the upper reach of the conveyor 7.

The speed of the upper reach of the endless belt of the conveyor 6 is preferably in the range of between 2.5 and 3.5 meters per second which approximates or equals the floating speed of satisfactory particles 3 (e.g., shreds or analogous fragments of tobacco leaf laminae). A presently preferred speed of particles on the conveyor 6 is about 2.7 meters per second which is close to an average floating speed of approximately 3 meters per second. The foreign particles 23 of the first flow descending from the oscillatory trough 19 of the transporting unit 18 onto the first conveyor 6 can include fragments of tobacco ribs, birds' eyes, fragments of metallic material and/or others.

The second or last conveyor 7 of the cascade 4 cooperates with an additional (overhead) conveyor 8 which constitutes a belt conveyor having an endless flexible element trained over suitable pulleys or the like (the same as the conveyors 6, 7). The lower reach of the endless flexible element of the additional conveyor 8 cooperates with the upper reach of the endless flexible element of the last conveyor to define an elongated channel 13 wherein the accelerated (and thus thinner) flow of randomly intermixed particles 3 and 23 advances in the direction of the arrow 2. The height of the channel 13 preferably decreases, at least slightly, toward a mouthpiece 12 which is defined by pulleys or rods 9 and 11 of the respective conveyors 8 and 7.

Figure 2:
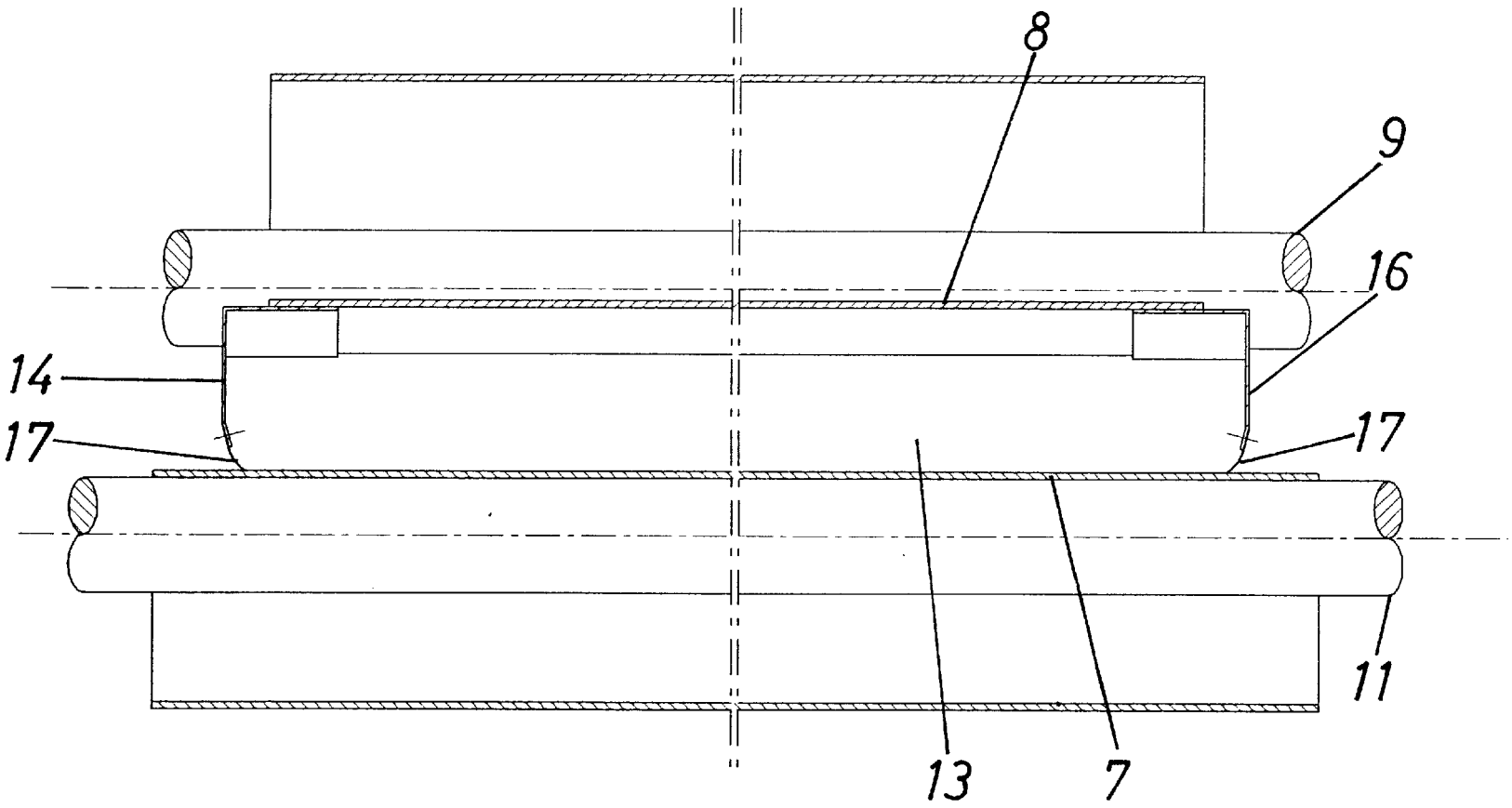
FIG. 2 is an enlarged transverse vertical sectional view substantially as seen in the direction of arrows from the line A—A in FIG. 1.

As can be seen in FIG. 2, the sides of the channel 13 are flanked by two sidewalls 14, 16 which can be made of a metallic sheet material and include inwardly bent upper portions slidably supporting the adjacent marginal portions of the lower reach or stretch of the endless flexible element of the additional conveyor 8. The lower portions of the sidewalls 14, 16 carry flexible lips or flaps 17 which sealingly engage the adjacent marginal portions of the upper reach of the endless flexible element of the last conveyor 7. Those sides of the lips 17 which contact the conveyor 7 can be provided with layers of felt or the like.

The oscillatory trough 19 of the advancing or transporting unit 18 is or can be horizontal, the same as the upper reaches of the endless flexible elements of the conveyors 6, 7 forming part of the cascade 4.

The reference character 1 denotes a monitoring and segregating unit which is located immediately downstream of the conveyor 7 and, in the illustrated embodiment, comprises a battery of conventional laser detectors 21 disposed at one side of the path of intermixed particles 3, 23 and opposite a standard reference drum 22 the color of which is properly attuned to that of tobacco. The unit 1 further cooperates with or includes, as an integral part, an image processor which recognizes and memorizes the positions of foreign particles 23 in the second flow (such as a single layer) of particles advancing beyond the mouthpiece 12. The processor transmits signals to ejector nozzles 24 which expel the foreign particles 23 into a first collector 27. The remaining (satisfactory) particles 3 are propelled into a separate collector 26. Each of the collectors 26, 27 can comprise, cooperate with or constitute a conveyor which serves to deliver the respective particles to a further processing station.

The operation of the improved apparatus is as follows:

It is assumed that the apparatus is designed to process about ten tons of comminuted tobacco leaves per hour. This can be readily accomplished by selecting an apparatus wherein the trough 19 and the conveyors 6, 7, 8 have a width (as measured at right angles to the plane of FIG. 1) of approximately 1.6 meters.

The trough 19 delivers a first flow having a height of between 4 and 10 centimeters (e.g., approximately 7 centimeters) at a speed of 0.4 meter per second, and successive increments of such flow descend onto the upper reach of the endless flexible element of the first conveyor 6 of the cascade 4. The speed of the endless flexible element of the conveyor 6 is approximately 2.7 meters per second which entails a reduction of the height of the flow of intermixed tobacco particles 3, 23 from about 7 centimeters to approximately 2 centimeters.

The discharge end of the conveyor 6 showers tobacco particles onto the upper reach of the endless flexible element of the last conveyor 7 which is driven to advance the intercepted particles at a speed of approximately 5.7 meters per second. This entails a further reduction of the thickness or height of the tobacco flow from about 2 centimeters to about one centimeter. This is accomplished in part by acceleration of intermixed particles 3, 23 upon descent onto the conveyor 7 as well as by atmospheric air which is entrained by moving conveyors 7, 8 and by the tobacco particles supplied by the conveyor 6. The entrained air produces a ventilating effect which causes a stretching of the tobacco flow. Such stretching is highly satisfactory when the endless flexible element of the conveyor 7 is driven at a speed of about 5.7 meters per second. The speed of the conveyor 8 can match that of the conveyor 7.

The thus obtained flow (having a height of approximately one centimeter in contrast to the initial height of about 7 centimeters) is advanced into the range of the unit 1, i.e., past the battery of laser detectors 21 which extend across the full width of the path for the tobacco flow downstream of the mouthpiece 12. Signals from the detectors 21 are processed in the aforedescribed manner (which forms no part of the present invention) and the processed signals are utilized to activate the nozzles 24 which expel the foreign particles 23 into the collector 27 while the satisfactory (useful) particles 3 advance into and are collected in the device 26.

If necessary or worthwhile, the particles 23 in the collector 27 can be subjected to a further classifying action to recover particles which can be reintroduced into the transporting unit 18. The same holds true for the particles which gather in the collector 26; such particles can be sifted and/or otherwise manipulated to segregate additional foreign particles, if any.

The improved apparatus is susceptible of numerous additional modifications without departing from the spirit of the present invention. For example, if the output of the apparatus is to be increased (e.g., beyond ten tons per hour), the illustrated cascade 4 can be replaced with a cascade having more than two successive conveyors, e.g., an additional conveyor between the conveyors 6 and 7.

An important advantage of the improved apparatus is that the height of the flow issuing from the channel 13 is uniform which facilitates the task of the combined monitoring and classifying unit 1. Furthermore, the improved apparatus can process substantial quantities of intermixed satisfactory and foreign particles per unit of time. Closing of the sides of the channel 13 (by the illustrated sidewalls 14, 16 or the like) also contributes to the efficiency of the apparatus and to greater effectiveness of the air flow which enters the channel 13 at the discharge end of the conveyor 6.

The improved apparatus has been found to be particularly suitable for the processing of flows or streams of comminuted tobacco leaves. However, and as already pointed out hereinbefore, the apparatus can be utilized with equal or similar advantage for the classification of other types of flows wherein desirable or satisfactory particles are randomly intermixed with less desirable or undesirable particles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of particle classifying apparatus and, therefore, such adaptations should and are intended to be comprehended within the meaning and range of equivalence of the appended claims.

What is claimed is:

1. Apparatus for converting a continuously supplied multiple-layer first flow of a particulate material containing randomly intermixed useful and foreign particles into a second flow which, during advancement of particulate material in a predetermined direction along a predetermined path, includes a number of layers less than the number of layers in said multiple-layer first flow, comprising:

at least one transporting unit having means for advancing the first flow at a first speed along a first portion of said path;

a plurality of successive conveyors adjacent successive second portions of said path and arranged to repeatedly accelerate the first flow along the respective second portions of said path with attendant reduction of the number of layers in the flow on said conveyors, said conveyors including a first conveyor arranged to receive particles of the first flow from said advancing means and a last conveyor; and means for segregating foreign particles from useful particles not later than downstream of said last conveyor.

2. The apparatus of claim 1, wherein said conveyors include endless flexible elements trained over pulleys and having upper reaches arranged to advance the layers of useful and foreign particles along said second portions of said path.

3. The apparatus of claim 1, wherein said successive second portions of said path immediately follow each other.

4. The apparatus of claim 1, wherein said at least one transporting unit includes an oscillatory trough arranged to advance a first flow having a thickness in the range of between 4 and 10 millimeters.

5. The apparatus of claim 4, wherein the thickness of the first flow is approximately 7 millimeters.

6. The apparatus of claim 1, wherein said first conveyor includes at least one endless flexible element and pulleys arranged to drive an upper reach of said at least one endless flexible element in said direction at a speed of between about 2.5 and 3.5 meters per second away from said at least one transporting unit.

7. The apparatus of claim 6, wherein the speed of said upper reach at least approximates the floating speed of the particles in at least one of said flows.

8. The apparatus of claim 1, further comprising an additional conveyor defining with said last conveyor a channel having a height diminishing in said direction and means for driving said additional conveyor in synchronism with said last conveyor.

9. The apparatus of claim 8, wherein said last conveyor comprises an endless flexible element having an upper reach bounding said channel from below and pulleys arranged to drive said upper reach in said predetermined direction, said additional conveyor comprising an endless flexible element having a lower reach bounding said channel from above and pulleys arranged to drive said lower reach in said predetermined direction.

10. The apparatus of claim 1, further comprising means for respectively driving said first and last conveyors at a lower speed and a higher speed, the ratio of said lower and higher speeds being such that the thickness of the flow on said first conveyor is at least approximately twice the thickness of the flow on said last conveyor.

11. The apparatus of claim 10, wherein at least one of said conveyors is an endless belt conveyor having an at least substantially horizontal flow-supporting upper reach.

12. The apparatus of claim 1, wherein said at least one transporting unit includes an oscillatory trough and the first flow has a thickness in the range of between 4 and 10 centimeters, said conveyors defining at least substantially horizontal portions of said path.

13. The apparatus of claim 1, further comprising an additional conveyor defining with said last conveyor a channel having a height diminishing in said direction, means for driving said additional conveyor in synchronism with said last conveyor, and sidewalls flanking said channel.

14. The apparatus of claim 13, wherein said sidewalls include substantially horizontal upper portions slidably guiding said additional conveyor.

15. The apparatus of claim 14, wherein said sidewalls further comprise lower portions provided with flexible lips sealingly engaging said last conveyor.

16. The apparatus of claim 13, wherein said sidewalls contain a metallic sheet material.

* * * * *